United States Patent [19]

Hennequin et al.

[11] Patent Number: 4,865,108

[45] Date of Patent: Sep. 12, 1989

[54] FRAME FOR A RETRACTABLE BLIND

[75] Inventors: Petrus J. Hennequin, Rotterdam; Herman Oskam, Vlist, both of Netherlands

[73] Assignee: Hunter Douglas International N.V., Curacao, Netherlands

[21] Appl. No.: 217,091

[22] Filed: Jul. 7, 1988

Related U.S. Application Data

[63] Continuation of Ser. No. 939,984, Dec. 10, 1986, abandoned.

[30] Foreign Application Priority Data

Dec. 27, 1985 [EP] European Pat. Off. ..... 85116592.8

[51] Int. Cl.[4] ..... E06B 9/30

[52] U.S. Cl. ..... 160/172; 160/178.1; 160/279

[58] Field of Search ..... 160/172, 173, 168.1, 160/178.1, 84.1, 166.1, 107, 34, 239, 240, 265, 269, 31, 279

[56] References Cited

U.S. PATENT DOCUMENTS

| | | | |
|---|---|---|---|
| 2,389,956 | 11/1945 | Castilonia | 160/172 |
| 2,557,978 | 6/1951 | Krumm | 160/107 X |
| 2,617,480 | 11/1952 | Swackhamer | 160/34 |
| 2,639,766 | 5/1953 | Pratt | 160/40 |
| 3,795,267 | 3/1974 | Debs . | |
| 4,202,395 | 5/1980 | Heck et al. . | |
| 4,444,243 | 4/1984 | Voney et al. | 160/172 |
| 4,557,309 | 12/1985 | Judkins | 160/84 R |
| 4,673,018 | 6/1987 | Judkins | 160/84 R |
| 4,679,610 | 7/1987 | Spraggins | 160/84 R X |

FOREIGN PATENT DOCUMENTS 8110574 10/1981 Fed. Rep. of Germany .

*Primary Examiner*—Ramon S. Britts
*Assistant Examiner*—David M. Purol
*Attorney, Agent, or Firm*—Pennie & Edmonds

[57] ABSTRACT

A frame for a retractable blind which can be gathered together, said frame comprises an upper head-rail consisting of a hollow profile, a bottom rail which can be raised and lowered and which forms the bottom of the blind, lateral profiles, corner members connecting the head-rail to the lateral profiles, longitudinal channels in said lateral profiles, draw cords passing through the lateral channels, a plurality of cord passages in said corner parts, all of which are connected to one another via a common space and a sliding surface associated with each cord passage to deflect the draw cords, as they pass from the head-rail to the associated lateral profile.

21 Claims, 4 Drawing Sheets

FRAME FOR A RETRACTABLE BLIND

RELATED APPLICATION

This application is a continuation of application Ser. No. 939,984 filed Dec. 10, 1986, now abandoned.

BACKGROUND OF THE INVENTION

The present invention relates to a frame retractable blind or screen which can be gathered up. One general type of such a frame has an upper head-rail consisting of a hollow profile, and a bottom rail which can be raised and lowered, and which forms the bottom of the frame, and which can be actuated for the purposes of raising and lowering the blind. Lateral profiles, though which cords run, are attached to the head-rail by means of corner members.

It is known to provide, for example, slatted Venetian blinds, particularly for fixing to the insides of inclined skylights, having metal profiles fixed laterally to their top horizontal head-rail by means of corner members. Each of these lateral, obliquely extending profiles has a cavity in which in each case a carriage is guided, these carriages supporting the bottom strip, cf German Utility Model 8110574.

Widely varying methods are known for actuating known Venetian blinds and for providing stability in the case of special Venetian blinds such as for roof windows, skylights, etc. Each of these forms of actuation requires different means of guiding the cords used. The conventional frames for retractable blinds are restricted to one, or at most two, forms of actuation so that alternative forms of actuation are not possible or require different structural parts.

SUMMARY OF THE INVENTION

It is an object of the invention to provide a frame for retractable blinds of the type initially mentioned which permits the most varied forms of actuation and fixing and a wide variety of guide arrangements for the cords used for the purpose.

According to the invention there is provided a frame for a retractable screen which can be gathered together. The frame comprises an upper head-rail consisting of a hollow profile, a bottom rail which can be raised and lowered and which forms the bottom of the frame, lateral profiles, corner members connecting the head-rail to the lateral profiles, longitudinal channels in said longitudinal profiles, draw cords passing through the lateral channels, a plurality of cord passages in the corner members, all of which are connected to one another via a common space and a sliding surface associated with each cord passage to deflect the draw cords, as they pass from the head-rail to the associated lateral profile.

A design of this type permits a very wide variety of guideways for the draw cords, which term is used to include actuating, tensioning and/or guiding cords, so that a high degree of variability of actuation of the retractable screen such as a Venetian blind is achieved, in particular, by means of the assembly. This means not only that the form of actuation can be changed after installation, but also that the widest variety of versions of Venetian blinds or roller blinds can be offered and sold without requiring different individual parts. Passages are understood to mean the paths to be followed by the cords.

Thus, draw cords can be brought out at the top corner member or at a bottom foot member or at both in order to be manipulated. They can however also be actuated by an operating slide guided in the lateral profile, or the bottom rail can be moved directly by hand and merely guided by the tensioning cords, it being possible for these tensioning cords to be fixed or movable. Tensioning and/or guiding cords can also be used in addition to actuating cords, specifically in the case of obliquely or horizontally positioned blinds. Each of these forms of actuation requires very different guidings of the cords, all of which can be implemented by means of the invention.

It is particularly advantageous in this context if a plurality of passages extend from the common space to the head-rail and to the lateral profile. It is also proposed for this purpose that a plurality of passages leading from the common space to the front outer face should be provided.

It is advantageous if at least one passage terminates in the interior of the lateral profile. In this case the lateral profile can have two or more longitudinal channels, and one passage of each of the corner member can terminate in each of these channels. It is also proposed that upper passages, opposite to each other when viewed in the lengthwise direction of the head-rail, should be provided in the corner member, one of these passages in each case terminating in the head-rail. It is particularly advantageous if each of the opposing passages forms a plurality of exit directions and has corresponding sliding surfaces. In this case a passage can lead off from the upper passages and terminate at the front of the corner.

It is particularly advantageous if the passages are formed by a separate moulding which is fixed in the interior of the corner member. A moulding of this type, lying in the corner member, may be produced from particularly hard-wearing material, and especially from plastic which is resistant to cord friction, so that the degree of wear is low. In this context it is also proposed that two projections should be formed on the top of the moulding, forming between them a U-shaped passage, particularly a passage to the front. These upper projections ensure that the various cords are securely guided and do not become tangled, and these projections also form stops for the corner member.

Simple and secure fixing of the moulding is achieved, because the moulding can be pushed into the lateral profile from above by means of a projection.

Simple assembly and a large number of variations are achieved if a foot member is attached to the bottom end of each of the lateral profiles, this foot member having a plurality of passages for the cords. In this case at least one passage can terminate in the interior of the lateral profile. It is also proposed in this context that the lateral profile should have two longitudinal channels and that one passage of each foot member should terminate in each of these longitudinal channels. Moreover, a passage can terminate at the front of the foot member. A passage can also terminate at the side facing the side-piece of the window. In a further alternative it is proposed that a passage terminates horizontally in the side facing the opposite foot member.

In an advantageous embodiment it is proposed that, where the lateral profiles have two longitudinal channels, at least the rear one of these is open to the back over its entire length, and that a carriage be guided in the rear longitudinal channel, the bottom rail being fixed to this carriage. In this case the carriage can be fixed to the bottom rail via a tubular hollow bolt in which a draw-cord can be inserted, this draw-cord passing transversely through the bottom rail or being attached thereto. This results in a particularly simple and easily installed guiding of the cords. In this case the carriage may have a horizontal aperture into which the hollow bolt can be pushed, and a passage provided for the cords on or in the carriage is connected to the aperture.

In order that the invention will more readily be understood, the following description is given, merely by way of example, reference being made to the accompanying drawings.

DETAILED DESCRIPTION OF THE INVENTION

Figure 1A:
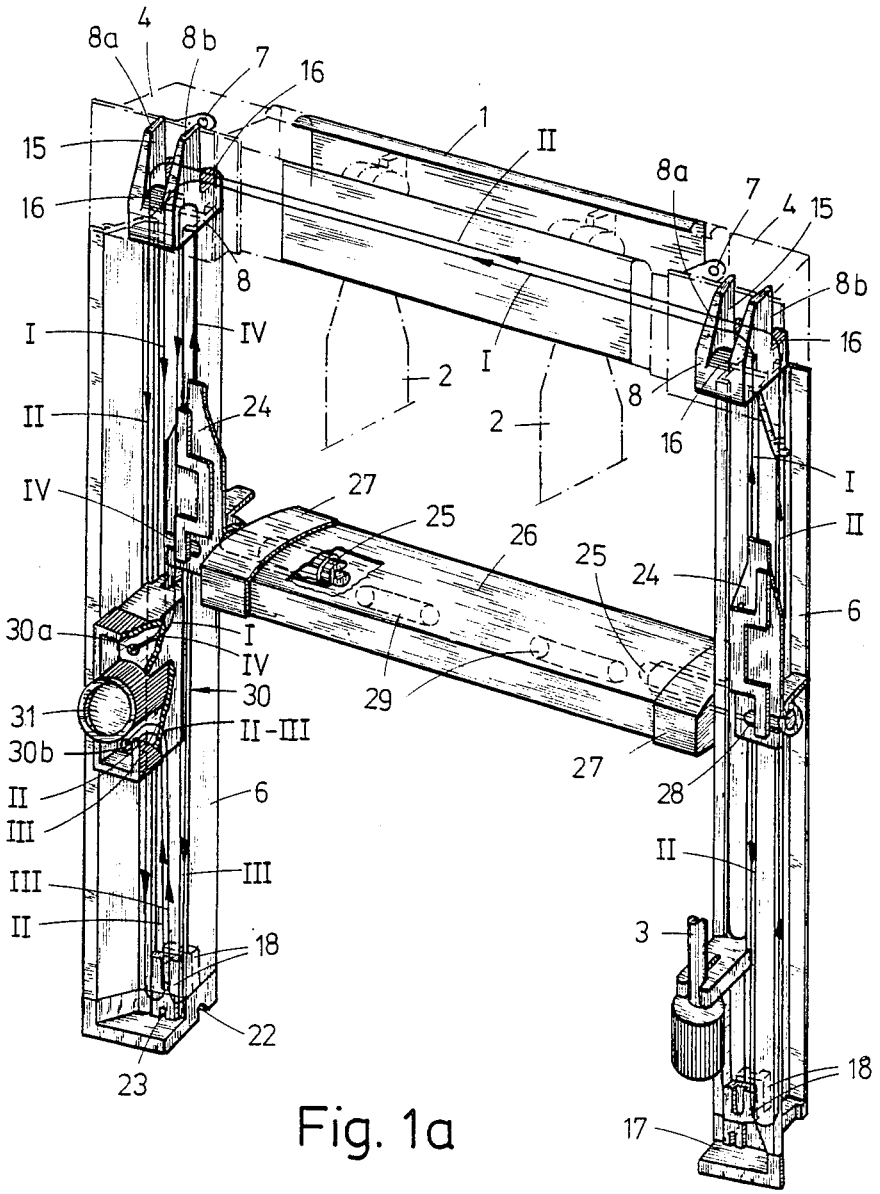
FIG. 1*a* is a perspective view of one embodiment of slatted Venetian blind, according to the invention partly broken away, and with the slats removed.
Figure 1B:
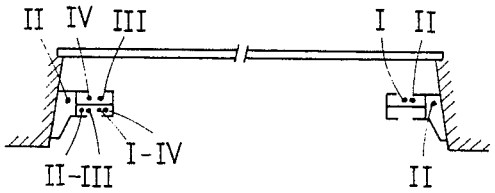
FIG. 1*b* is a horizontal section to a reduced scale through the Venetian blind of FIG. 1.

A variety of retractable screens, such as a slatted Venetian blind, a folding Venetian blind, a folding curtain or a roller blind may be used with the frame disclosed herein. The invention is described below with reference to a slatted Venetian blind which, relative to other retractable screens, merely has an additional tilting device for the slats. The slatted Venetian blind shown with the frame in FIG. 1*a* is preferably fixed on the inside of an oblique roof window, particularly such a window which can also be tilted. The frame has a horizontal head-rail 1 which is U-shaped in cross-section, and from which ladder-cords 2 hang down, these ladder-cords being indicated in broken lines in FIG. 1*a* and holding the individual slats, which are not shown, at the necessary distance apart. A longitudinal tilt rod (not shown) is mounted in a conventional manner in the head-rail 1 and can be rotated by means of a tilt bar 3 in order to turn the slats by means of the ladder-cords 2.

Figure 2A:
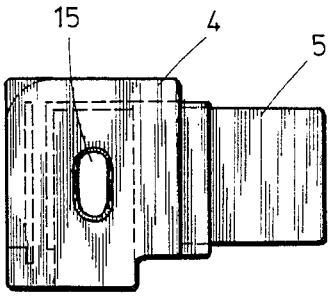
FIG. 2*a*, 2*b* and 2*c* are a front view, a side view and a plan view of the left corner member.
Figure 2B:
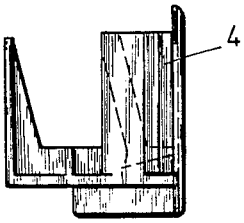
Figure 2C:
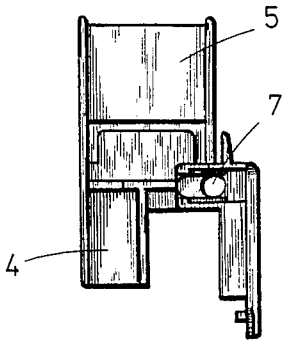

Projections 5 formed in corner members 4 are pushed into the ends of the head-rail 1 (cf FIGS. 2*a* and 2*c*). These corner members 4 provide a means of connection between the head-rail 1 and lateral profiles 6. The lateral profiles 6 are fixed to the lower parts of the generally square-shaped corner members 4 and extend downwards along both sides of the window, so that in the case of a sloping roof window, the profiles 6 are arranged parallel to the sloping window side-pieces.

Figure 6:
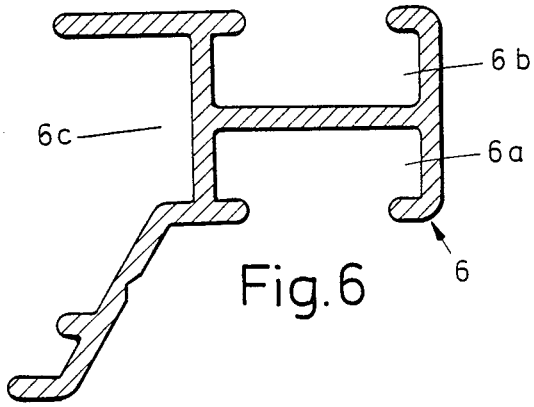
FIG. 6 is an enlarged section through a lateral profile of the blind.

The two lateral profiles 6 each form a front and rear channel 6*a*, 6*b*, through which the Venetian blind draw-cords can run (FIG. 6). These channels are open to the front and rear respectively over their entire length. Each corner member 4 has a hole 7 passing through the corner part from bottom to top, this hole being oblique and hence not parallel to the profile 6, and it being possible to push a wood screw into this hole in order to fix the corner member 4 to the top frame of the window.

Figure 3A:
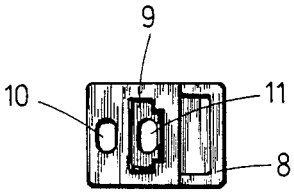
FIG. 3*a* is an bottom view of the moulding which is fixed within the corner member.
Figure 3B:
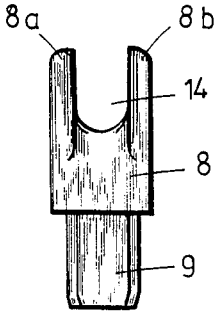
FIG. 3*b* is a lateral view of the moulding.
Figure 3C:
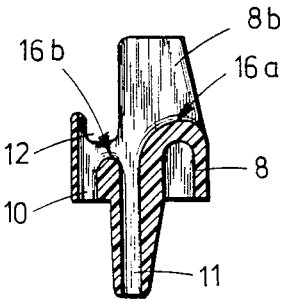
FIG. 3*c* is a section along A—A in FIG. 3*d;*
Figure 3D:
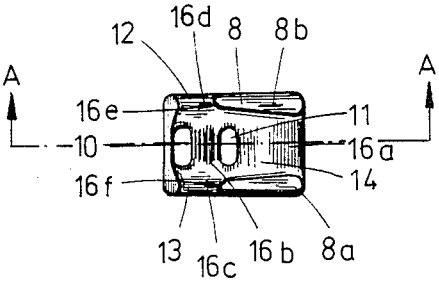
FIG. 3*d* is a plan view of the moulding.
Figure 4A:
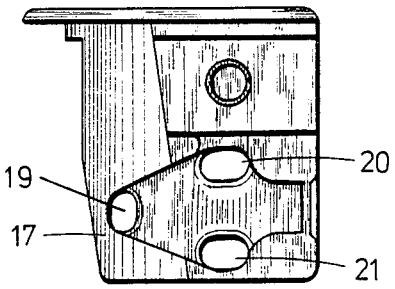
FIG. 4*a* is a view from below of the left foot member of the Venetian blind.
Figure 4B:
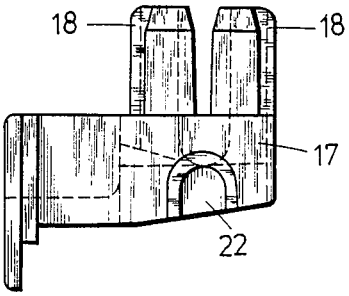
FIG. 4*b* and 4*c* are a side view and a front view of the foot members.
Figure 4C:
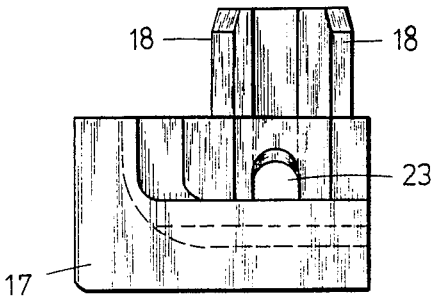
Figure 4D:
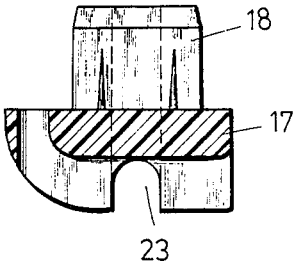
FIG. 4*d* is a section along A—A of FIG. 4*e;*
Figure 4E:
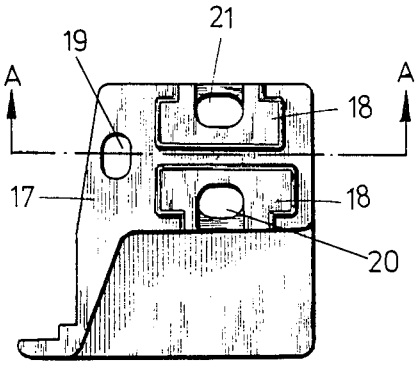
FIG. 4*e* is a plan view of the foot member.
Figure 5:
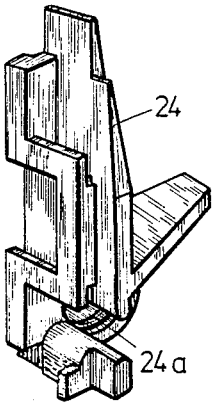
FIG. 5 is a perspective view of the carriage of the frame.
Figure 5A:
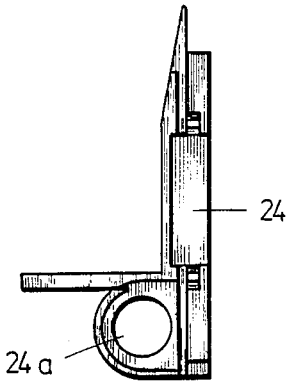
FIG. 5*a* is a side view of the carriage.

A moulding 8 fits snugly in the interior of the hollow plastic corner member 4, this moulding 8 consisting either of a metallic material or of a plastic which has high wear resistance to the friction of the draw-cords and forming the passages for the draw-cords through the corner member 4. The moulding 8 has a projection 9 (FIGS. 3*a*–3*c*) on its lower side, this projection resting in the rear longitudinal channel 6*b* of the profile 6. In order to form the passages, the moulding 8 has two downward-extending channels 10, 11 (FIGS. 3*c*, 3*d*) which terminate in the longitudinal channels 6*a*, 6*b* of the profile 6. The channels 10, 11 extend from a central region of the moulding 8, and three additional passages 12, 13, 14 also start from this region, of which the passage 12 extends horizontally to the interior of the head-rail 1 and the passage 13 extends horizontally outwards in the opposite direction. A passage 14 also begins in the central region of the moulding 8, extends to the front of the corner member 4 and terminates through an aperture 15 in the corner member 4 (FIG. 2*a*). The passages 10–14 are thus all connected to each other in the interior of the moulding 8 and hence also in the interior of the corner members 4, and extend from this central region with two passages 10, 11 downwards into the channels of the profile 6, to both sides (passages 12, 13) and forwards (passage 14). Since a draw-cord passing through one of the passages into the interior of the moulding 8 can emerge again through one of the other passages, and since these passages are at right angles to each other, curved sliding surfaces 16 are arranged as the transition between the passages in order to guide the draw-cord in question. Because of the many types of connection between the passages, the moulding has a total of six sliding surfaces 16*a*-*f*. Because of the high slip and wear resistance of the moulding, the draw-cords can be drawn over these sliding surfaces without significant friction.

The moulding 8 has projections 8*a*, 8*b* moulded onto its top and extending upwards, the passage 14 running between these projections which, with their tops, form stops for the surface of the corner member 4. These projections 8*a*, 8*b* form the slip surfaces 16*a*, 16*f* with their longitudinal edges, which run approximately vertically.

At the bottom of each of the profiles 6 a foot member 17, having projections 18, is pushed into the longitudinal channels 6*a*, 6*b*. In a similar manner to the corner part 4, the foot part 17 has a plurality of passages for the draw-cords (FIGS. 4*a*–4*e*). The passages 20, 21 extending parallel to the profiles 6 lead to the interior of the foot members 17, from which passages 22, 23 extend to the side or forward. In this case, the passage 22 leads towards the opposite foot member. It is important that, in the same way as in the case of the moulding 8, all passages are connected to one another via the internal cavity of the foot member 17, so that a draw-cord entering the interior of the foot part through one of the passages can emerge through one of the other passages. An additional frame profile (not shown) can, if required, be provided between the foot parts 17 at the level of the foot parts. A further passage 19 can also terminate at the side facing the side-piece of the window, in a region covered by the lateral profile.

Figure 7A:
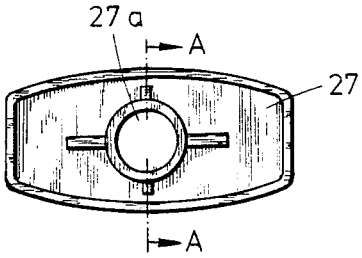
FIG. 7*a* is a lateral view of an end cap which can be pushed on either end of the bottom rail.
Figure 7B:
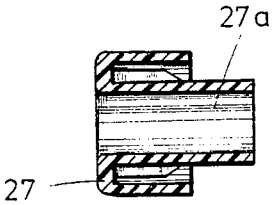
FIG. 7*b* is a section along A—A on FIG. 7*a*.

A carriage 24 lies slidingly in the rear longitudinal channel **6*b* of the profile 6, it being possible for upward or downward extending draw-cords which run in the rear channel 6*b* to be attached to this carriage 24. A hollow bolt 25 is horizontally attached to the carriage 24 and passes axially into the bottom rail 26 of the Venetian blind. For this purpose the end parts 27 pushed onto both ends of the bottom rail 26 have apertures 27*a* (FIGS. 7*a*–7*b*). Draw-cords can run through these hollow bolts 25, and rest in the interior of the bottom rail 26 and, after emerging on the outside from the hollow bolts 25, are deflected via slip surfaces 28 of the carriage 24 into the rear channel 6*b* of the profile 6. The continuous draw-cords can be fixed under tension by means of tension springs 29 which may be located in the bottom rail 26**.

A operating slide 30 is slidingly mounted in the front longitudinal channel **6*a* of the left profile 6, this slide 30 being manually pushed downwards in order to move the bottom rail 26 upwards and being pushed upwards in order to lower the bottom rail. The slide 30 has a top aperture 30*a*, in which two cords I, IV extending downwardly from above are clamped, and a bottom aperture 30*b* in which two cords II, III extending upwardly from below through the profile 6 are clamped. The slide 30 can be clamped to the profile 6 by means of a lock (rotating knob) 31, so that the bottom rail can be immovably locked. In the clamped state, the cords I–IV can be released, i.e. can rest movably in the apertures 30*a*, 30*b* of the slide 30, so that the bottom strip 26** can be moved up and down by pulling alternately on these cords.

The cords I–IV can be threaded through the parts of the frame in a variety of ways. One of the methods of fixing and laying the cords is described below, reference being made to FIGS. **1*a* and 1*b*. To the right-hand carriage 24 is fixed, in particular, the end of the cord I which rests in the rear channel 6*b* of the profile 6 and is guided upwards through this channel. The right-hand moulding 8 deflects the cord I into the head-rail 1, and the cord I runs through the interior of the head-rail 1 to the left-hand moulding 8, which guides the cord I into the front channel 6*a* of the left-hand profile 6. From the channel 6*a* the cord I passes to the slide 30, to which it is attached, or through which it can be pulled in the clamped position of the slide. In the same way a cord IV is attached to the left-hand carriage 24, particularly at the top, this cord IV passing through the rear channel 6*b* of the left-hand profile, through the left-hand moulding 8 and through the front channel 6*a* to the handle 30. The bottom rail 26 can be pulled up via the carriages 24** by means of the two cords I, IV if the handle is pushed downwards or if the cords are pulled forwards out of the slide when the latter is locked.

On the bottom rail 26, two further cords II, III, are attached, in particular, to the carriage 24 or are attached to the springs 29. The right-hand cord II is guided downwards through the rear channel **6*b* of the right-hand profile 6 to the right-hand foot member 17, deflected by this into the channel 6*c* of the profile, guided upwards through the channel 6*c* to the right-hand moulding 8, from there through the head-rail to the left-hand moulding 8 and into the channel 6*c* of the left-hand profile 6 to the left-hand foot member 17 which deflects the cord II into the front channel 6*a* and upwards to the slide 30. In the same manner, a cord III is attached to the left-hand spring 29 or carriage 24 and enters the rear channel 6*b* of the left-hand profile 6 via the left-hand carriage 24, this channel 6*b* guiding it to the left-hand foot member 17 which deflects the cord III into the front channel 6*a* and upwards towards the slide 30. Pulling on the cords II, III by moving the slide 30 upwards or by directly pulling these cords out of the slide 30 when it is locked results in the lowering of the bottom rail 26**.

The mouldings 8, foot members 17 and profiles 6 permit numerous other ways of guiding and actuating the Venetian blind and cords. For example, cords can emerge, for the purposes of actuation, from one of the corner members 4 or foot members 17 and can also pass transversely through the bottom rail 26.

It is particularly important that the carriages 24 are slidingly guided in the rear channels **6*b* and the cords starting from there extend in the first region in these channels 6*b*, and that the slide 30 is slidingly guided in one of the two front channels 6*a* and the cords starting from the said handle slide in these channels 6*a*** in the first region.

We claim:

1. A frame for a rectractable blind having front and rear faces comprising:

(a) a headrail of generally U-shaped cross-sectional shape, defining a passage for blind operating cords therein;

(b) corner members attached at each end of the headrail, the corner members each comprising:

(i) an outer housing member comprising means for forming a structural connection to said headrail and means for receiving and retaining an inner molded body member, and (ii) an inner molded body member received and retained by said outer housing member, said molded body member having fromed therein a number of apertures defining a plurality of distinct passageways for operating cords therein and further having formed therein a cavity defining a common space in communication with the distinct passageways, whereby the distinct passageways communicate with one another other;

(c) first and second lateral profiles, each attached at its upper end to an end of the headrail by means of the corner members, the lateral profiles extending downward therefrom and disposed parallel to each other, the lateral profiles each defining at least one longitudinal channel for operating cords, said channels being in communication with the passageway of the upper headrail by means of the plurality of distinct passageways and the common space defined by the corner members; and (d) a bottom rail disposed between the first and second lateral profiles, raiseable and lowerable with respect to the headrail.

2. The frame as in claim 1, further comprising:

(a) a curved sliding surface associated with each of the distinct passageways defined by the corner members, whereby movement of operating cords therethrough is facilitated.

3. The frame as in claim 1, wherein:

(a) at least one of the passageways in each of the corner members extends into the channel of the corresponding lateral profile and terminates therein.

4. The frame as in claim 3, wherein:

(a) each lateral profile defines at least two longitudinal channels; and (b) one of the distinct passageways defined by each of the corner members extends into each of said longitudinal channels and terminates therein, in communication with the channel.

5. The frame as in claim 1, wherein:

(a) each corner member further defines an upper passageway, said upper passageways being oriented longitudinally in line with and communicating with the passage defined by the headrail;

(b) the upper passageway further communicating with the common space; and (c) the upper passageway further defining an opening directly opposite the passage defined by the headrail.

6. The frame as in claim 5, wherein:

(a) each corner member further defines a plurality of exit apertures in its respective common space; and (b) each exit aperture forms corresponding curved sliding surfaces in their respective corner members.

7. The frame as in claim 1, wherein:

(a) each corner member further defines a forward passageway in communication with the common space, said forward passageway terminating at a front face of the frame.

8. The frame as in claim 1, wherein each corner member further comprises:

(a) two projections extending upward from the separate molding, said projections forming between them a U-shaped passage extending to a front face of the frame.

9. The frame as in claim 1, further comprising:

(a) first and second foot members fixed at lower ends of the first and second lateral profiles, each foot member defining a plurality of passages therein for operating cords, said passages each being in communication with one another.

10. The frame member as in claim 9, wherein:

(a) each lateral profile defines at least two longitudinal channels; and (b) one of said passages defined by each foot member extends into each of said longitudinal channels and terminates therein, in communication with the channel.

11. The frame as in claim 9, wherein:

(a) at least one passage defined by each foot member terminates at a front face of the frame.

12. The frame as in claim 9, wherein:

(a) one of the passages defined by each foot member extends horizontally and defines an opening in its respective foot member facing the opposite foot member.

13. The frame as in claim 1, wherein:

(a) each lateral profile defines a front and rear longitudinal channel; and (b) a rear channel is open to the rear face of the frame along its length.

14. The frame as in claim 13, further comprising:

(a) two carriages, one slidably guided in each rear longitudinal channel, the bottom rail affixed to the carriages.

15. The frame as in claim 14, further comprising:

(a) a hollow bolt securing each carriage to the bottom rail, said hollow bolts defining a passageway for operating cords into the bottom rail.

16. The frame as in claim 15, wherein:

(a) each carriage defines a horizontal aperture through which the hollow bolt extends, said horizontal aperture providing a passageway for operating cords therethrough.

17. The frame as in claim 13, further comprising:

(a) an operating slide slidably mounted in one of the front channels, said operating slide defining at least one passageway for operating cords therein, whereby movement of the operating slide controls the raising and lowering of the bottom rail.

18. The frame as claimed in claim 17, wherein said operating slide comprises:

(a) at least one clamping means for fixing an operating cord thereto; and (b) a locking means for selectively locking the operating slide in desired positions.

19. The frame of claim 1, wherein said outer housing members of said corner members each comprise tongue members adapted to be received and retained within said U-shape headrail.

20. The frame of claim 1, wherein said inner molded body members comprise means for forming a structural connection to said lateral profiles.

21. The frame of claim 20, wherein said inner molded body members comprise projections integrally formed therein which fit within corresponding recesses in said lateral profiles for retention thereby.

* * * * *